US012486013B2

(12) United States Patent
Fuehring

(10) Patent No.: US 12,486,013 B2
(45) Date of Patent: Dec. 2, 2025

(54) END CAP FOR GUIDING AN EXHAUST GAS FLOW OF A BOAT ENGINE, PROPELLER SYSTEM FOR A BOAT ENGINE, BOAT ENGINE, AND USE OF AN END CAP AND METHOD FOR GUIDING AN EXHAUST GAS FLOW OF A BOAT ENGINE

(71) Applicant: Neuro-Net GmbH, Groß Pampau (DE)

(72) Inventor: Andre Fuehring, Gross Pampau (DE)

(73) Assignee: Neuro-Net GmbH, Gross Pampau (DE)

( * ) Notice: Subject to any disclaimer, the term of this patent is extended or adjusted under 35 U.S.C. 154(b) by 413 days.

(21) Appl. No.: 18/124,736

(22) Filed: Mar. 22, 2023

(65) Prior Publication Data

US 2023/0331363 A1 Oct. 19, 2023

(30) Foreign Application Priority Data

Mar. 24, 2022 (DE) ..... 10 2022 106 979.6

(51) Int. Cl.
*B63H 20/26* (2006.01)

(52) U.S. Cl.
CPC ..... *B63H 20/26* (2013.01)

(58) Field of Classification Search
CPC ..... B63H 20/20; B63H 20/24; B63H 20/26; B63H 1/28; B63H 2001/283
USPC ..... 440/88, 89
See application file for complete search history.

(56) References Cited

U.S. PATENT DOCUMENTS

| | | | | |
|---|---|---|---|---|
| 3,947,151 | A * | 3/1976 | Stillerud | B63H 20/245 440/89 R |
| 4,834,683 | A | 5/1989 | Govan | |
| 9,914,515 | B1 | 3/2018 | Powers | |
| 2015/0132145 | A1 | 5/2015 | Taylor | |

FOREIGN PATENT DOCUMENTS

WO 2014020551 A1 2/2014

* cited by examiner

*Primary Examiner* — Daniel V Venne
(74) *Attorney, Agent, or Firm* — Scully, Scott, Murphy & Presser, P.C.

(57) ABSTRACT

An end cap for guiding an exhaust gas flow of a boat engine. The end cap is configured to be attached onto a propeller nut of the boat engine. The end cap including: a base body having a bottom surface, a lateral surface and a tip, the tip and the bottom surface being spaced apart from each other in a longitudinal direction of the base body. The lateral surface extends from the bottom surface and converges in the tip. The bottom surface having a recess for receiving the propeller nut; and at least one exhaust gas-guiding structure extends helically along the lateral surface.

19 Claims, 7 Drawing Sheets

END CAP FOR GUIDING AN EXHAUST GAS FLOW OF A BOAT ENGINE, PROPELLER SYSTEM FOR A BOAT ENGINE, BOAT ENGINE, AND USE OF AN END CAP AND METHOD FOR GUIDING AN EXHAUST GAS FLOW OF A BOAT ENGINE

CROSS-REFERENCE TO RELATED APPLICATION

The present application is based upon and claims the benefit of priority from DE 10 2022 106 979.6 filed on Mar. 24, 2022, the entire contents of which is incorporated herein by reference.

BACKGROUND

Field

The present disclosure relates to an end cap for guiding an exhaust gas flow of a boat engine. In addition, the present disclosure relates to a propeller system for a boat engine, a boat engine, a use of an end cap for guiding an exhaust gas flow of a boat engine and a method for guiding an exhaust gas flow of a boat engine.

Prior Art

Boat engines, such as outboard engines or inboard engines, are used for driving various watercrafts, such as motor boats of various sizes, or as well as auxiliary propulsion for sailing boats or sailing ships.

As a propulsion system, in many cases, boat engines comprise a propeller that is set in rotation in order to therewith impart propulsion to the watercraft. In boat engines designed as internal combustion engines, a generated exhaust gas flow is regularly discharged via an exhaust duct, which is concentrically formed around a propeller shaft of the propeller. During boat movement the exhaust gas flow is often discharged in the stern direction in order to increase propulsion in this way.

One of the aims in the construction of boat engines is to convert the mechanical work provided by the engine into propulsion for the driven watercraft even more efficiently, as in this way higher speeds can be achieved and fuel can be saved.

SUMMARY

An object is to improve the efficiency of a boat engine.

Such object can be achieved by an end cap for guiding an exhaust gas flow of a boat engine, wherein the end cap is configured to be attached onto a propeller nut of the boat engine, wherein the end cap includes a base body having a bottom surface, a lateral surface and a tip, the tip and the bottom surface being spaced apart from each other in a longitudinal direction of the end cap, wherein the lateral surface, starting from the bottom surface, converges in the tip, wherein a recess for receiving the propeller nut is embedded in the bottom surface, wherein the end cap comprises at least one exhaust gas guiding structure helically running around the lateral surface.

Massive turbulences can be generated in the exhaust gas flow in the operation of the boat engine during cruise, which can reduce the propulsion generated by the propeller and therefore can have a negative effect on the efficiency of the boat engine. Such turbulences can be caused, inter alia, by a propeller nut centrally disposed at an exit of the exhaust gas duct and with which the propeller is fixed on the propeller shaft.

In order to reduce or completely avoid such turbulences, an end cap is provided, which is attachable onto the propeller nut. The end cap can comprise a base body having a bottom surface into which the recess is embedded. The recess can be formed complementary in form to the propeller nut. Thereby, the end cap can be securely and easily attached onto the propeller nut. The bottom surface can be formed annularly, wherein the recess can be embedded in the interior of the annular bottom surface.

In order to better guide the exhaust gas flow exiting the exhaust gas duct of the propeller, the base body of the end cap can comprise a lateral surface that, starting from the bottom surface, converges in the tip. This shape of the base body can be useful for guiding the exhaust gas flow along the lateral surface and for preventing the exhaust gas flow from stalling.

In order to reduce or completely avoid turbulences in the exhaust gas flow, the exhaust gas guiding structure can be provided on the lateral surface, running helically around the lateral surface. In this context, helically is synonymous with spirally. In other words, the exhaust gas guiding structure can wind on the outside around the lateral surface. The exhaust gas guiding structure can wind around the lateral surface by 45° to 360°, such as 160° to 360°, along a circumferential direction. The configuration of the helical structure may depend on its planned application. For example, high pitches, where the helical structure surrounds the lateral surface by ½, ¾ or more, may be found at rather low powers respectively horsepower numbers of the motor, while at higher horsepower numbers the pitch of the helical structure may tend to decrease, that is, may go towards' or even ¼.

Additionally, by use of the exhaust gas guiding structure on the end cap, a suction in the exhaust gas flow can be generated, which can exert a positive influence on an exhaust gas counter pressure of the boat engine. In this way, the resulting heterogeneous turbulences can be converted into a directed vortex with a suction effect. When the propeller rotates, the end cap rotates therewith, so that the exhaust gas flow is guided via the at least one helical exhaust gas guiding structure.

The exhaust gas guiding structure can protrude in a radial direction from the lateral surface and/or can be embedded in the lateral surface. Thereby, an effective guidance of the exhaust gas flow can be achieved.

A radial extension of the exhaust gas guiding structure can decrease, and such decrease can be continuously, from the bottom surface toward the tip of the base body along a longitudinal direction of the end cap, such as in a convex, conical or concave shape. The raw dial extension of the exhaust gas guiding structure can indicate how far the exhaust gas guiding structure protrudes from the lateral surface in the radial direction or is embedded in the lateral surface. By decreasing the radial extension of the exhaust gas guiding structure toward the tip, the suction effect in the resulting directed vortex can be improved. A concave or conical shape can be more suitable for applications where the end cap is sunk deep into the propeller, as is the case with some of the Mercury outboard engines. In this case, the convex shape can be advantageous in that the pressure on the component is greater than in the case of a concave shape. The latter can be, for example, well suited for shorter propellers, from which a concave cap also protrudes to a sufficient extent.

The exhaust gas guiding structure can end at or below the tip of the base body. In other words, in the alternative "below the tip", the tip of the base body, and not the exhaust gas guiding structure, can form the rear end of the end cap. This configuration can be advantageous for generating the directed vortex in the exhaust gas flow. In some cases, however, the exhaust gas guiding structure can also be continuous up to the tip of the base body.

The exhaust gas guiding structure can includes at least two, such as at least three, or at least six, exhaust gas guiding elements symmetrically offset to each other and helically running around the lateral surface. The number and configuration of the exhaust gas guiding elements may be differently and depends, inter alia, on a propeller size and a type of the boat engine. Due to the symmetrical arrangement along the lateral surface, a uniform directed vortex is generated.

According to an embodiment, the exhaust gas guiding structure can include at least one projection protruding from the lateral surface in a radial direction.

The configuration as a projection can result in that the exhaust gas guiding structure winding around the lateral surface efficiently guides the exhaust gas flow along the lateral surface when the propeller and thus the end cap rotates. In this embodiment, the exhaust gas guiding structure can be configured as at least one helix. A cross section of the projection can be rectangular.

According to an embodiment, a height of the projection at its highest section can correspond to 10% to 20% of a diameter of the bottom surface. In this embodiment, the at least one projection respectively helix can be configured relatively small compared to the base body. As so configured, the end cap can comprise six exhaust gas-guiding elements.

According to another embodiment, a height of the projection at its highest section can correspond to 20% to 70%, such as 40% to 50%, of a diameter of the bottom surface. In this embodiment, the at least one projection respectively helix can be configured relatively large. As so configured, the end cap can comprise three exhaust gas-guiding elements.

According to anther embodiment, the exhaust gas guiding structure can includes at least one groove embedded in the lateral surface in the radial direction. In this embodiment, the exhaust gas flow is thus not guided by one or more protruding helixes, but by one or more grooves embedded in the lateral surface. As so configured, the end cap can comprise six exhaust gas-guiding elements in the shape of grooves. A depth of the groove can decrease in the direction of a tip of the lateral surface. Such decrease can be continuously. The depth of the grooves in their deepest section can correspond to 2% to 5% of the diameter of the bottom surface. The groove(s) can comprise a curved cross-section surface.

The base body can be configured as a rotary body, the generating curve of which can be parallel to the axis of rotation in a section starting at the bottom surface and can decline in a subsequent section in a curve toward the axis of rotation and can intersect this one at an angle, such as at the tip of the base body, wherein the axis of rotation can be parallel to the longitudinal direction of the end cap, wherein the end cap and/or the base body can be configured axially symmetrically to a longitudinal axis of the base body. A rotary body is a body formed by rotation of the generating curve about the axis of rotation. The configuration of the base body as a rotational body, which can first extend parallel to the longitudinal direction and can finally converge in the tip on the rear side, can be advantageous for guiding the exhaust gas flow. In other words, the base body can be cylindrical starting at the bottom surface and transition to decreasing in width towards the tip. In this way, the width of the base body decreases from the bottom surface towards the tip.

A width of the base body can decrease starting from the bottom surface in the longitudinal direction toward the tip. Such decrease can be continuously. A curvature of the lateral surface can increases starting from the bottom surface in the longitudinal direction toward the tip. Such increase can also be continuously. Also, the decrease in the width and increase in the curvature toward the tip can improve the guidance of the exhaust gas flow.

The tip and/or the lateral surface in the area of the tip can be completely closed. As a result, the exhaust gas flow does not pass through the base body in the interior, but on the outside along the lateral surface.

At least one bore for receiving a cotter pin is introduced into the lateral surface. The bore can extend transversely to the longitudinal direction of the end cap. The bore can extend through an entire width of the lateral surface. Due to the at least one bore the end cap can be simply fixable on the propeller shaft. A cotter pin or splint pin is regularly provided for fixing the propeller nut to the propeller shaft. The end cap can also be fixable on the propeller nut by the same cotter pin with which the propeller nut is fixed on the propeller shaft. In this way, a fast and secure mounting of the end cap can be possible.

The recess can be configured as a blind hole, which can comprise an outer first receiving section and an inner second receiving section, wherein the second receiving section can be deeper than the first receiving section, wherein the first receiving section can have a circular outer circumference and/or the second receiving section can have a hexagonal outer circumference. Due to such configuration as a blind hole, the end cap can easily be attached onto the propeller nut. The second receiving section can be located on the inside and can be provided for receiving the propeller nut, while the exterior first receiving section can receive a widened section of the propeller shaft onto which the propeller nut is screwed. The second receiving section can be configured for receiving the propeller nut. The second receiving section can be configured complementary in form to the propeller nut. The at least one bore can pass through the second receiving section.

The blind hole can comprise a third receiving section that is disposed centrally in the second receiving section and is deeper than the second receiving section, the third receiving section, can have a circular outer circumference. Due to the three receiving sections in a stepped blind hole, the end cap can get simply and securely attached onto the propeller nut. The third receiving section can be configured for receiving a section of the propeller shaft of the boat engine. The third receiving section can be configured for receiving the section of the propeller shaft projecting in the longitudinal direction beyond the propeller nut.

Alternatively to a fastening with a cotter pin, in Mercury outboard engines a special nut with a special washer is used, which has extensions toward several sides, which prevent, inter alia, a rotation of the washer relative to the drive shaft. In the case of such a mercury fastening, for fastening the end cap, a nut can be used which comprises at least two blind holes, wherein additionally the end cap comprises corresponding threaded holes with grub screws, which can be screwed into the blind holes on the nut for fixation.

Such object can also be achieved by a propeller system for a boat engine, including a propeller, a propeller shaft and a propeller nut, wherein the propeller is fixed on the propeller shaft by the propeller nut, wherein the propeller has an exhaust gas duct that is disposed concentrically around the propeller shaft, the propeller system further includes an end cap according to one of the embodiments discussed above, which is attached onto the propeller nut, so that the end cap is disposed centrally in the exhaust gas duct or at an end of the exhaust gas duct. The propeller system embodies the same advantages, features and properties as the end cap described above.

The propeller system with the end cap can guide the exhaust gas flow significantly better than a propeller system without an end cap, since turbulences are reduced or avoided. The end cap can be disposed on the propeller nut such that the tip of the base body points to the rear and the bottom surface to the bow side.

Such object can be further achieved by a boat engine including a propeller system according to one of the embodiments described above, wherein the boat engine can be configured as an outboard engine. Also, the boat engine embodies the same advantages, features and properties as the end cap described above and the propeller system described above.

Such object can also be achieved by the use of an end cap according to one of the embodiments described above for guiding an exhaust gas flow of a boat engine.

Further, such object can be achieved by a method for guiding an exhaust gas flow of a boat engine, wherein an end cap according to one of the embodiments described above is attached onto a propeller nut of the boat engine, which can be fixed by a cotter pin.

The use of the end cap and the method for guiding an exhaust gas flow of a boat engine embody the same advantages, features and properties as the end cap described above, the propeller system described above and the boat engine described above.

BRIEF DESCRIPTION OF THE DRAWINGS

Further embodiments will become apparent from the description of the embodiments together with the claims and the attached drawings. Embodiments may fulfill individual features or a combination of several features.

The embodiments will be described below without restricting the general inventive idea on the basis of exemplary embodiments with reference to the drawings, and regarding any details which are not explained further in the text reference is expressly made to the drawings. In the drawings.

In the drawings, the same or similar types of elements and/or parts are provided with the same reference numbers so that a corresponding re-introduction is omitted, respectively.

DETAILED DESCRIPTION

Figure 1:
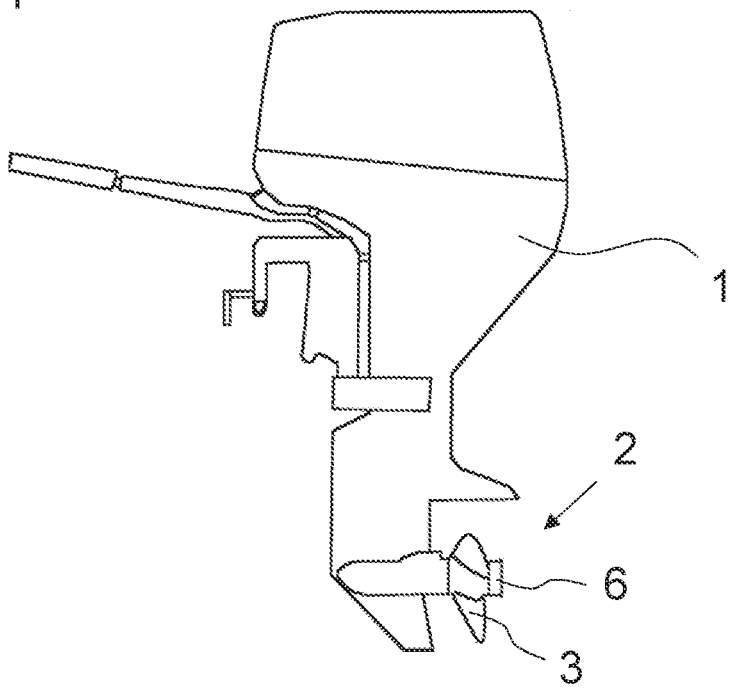
FIG. 1 illustrates a schematically simplified illustration of a boat engine in the form of an outboard engine.

FIG. 1 shows schematically simplified in a side view a boat engine 1, which is configured as an outboard engine in the example shown. Such boat engines 1 configured as outboard engines are frequently used for driving motor boats and as auxiliary propulsion for sailboats. For this purpose, the outboard engine is fixed to the stern of the boat. In operation of the boat engine 1, an upper part of the boat engine 1 emerges from the water, while a lower part is in the water. The lower part of the boat engine 1 comprises a propeller system 2 with a propeller 3, which imparts the outboard engine the necessary propulsion. For the ejection of exhaust gases, in addition, the propeller system 2 includes an exhaust gas duct 6, which extends between the blades of the propeller 3 to the rear and, at least when driving forward, generates a rearward exhaust gas flow.

Figure 2:
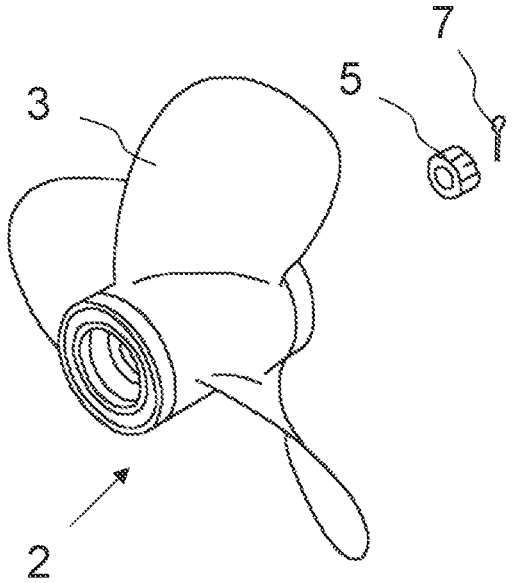
FIG. 2 illustrates a schematically simplified exploded illustration of a propeller system with a propeller, a propeller nut and a cotter pin.
Figure 3:
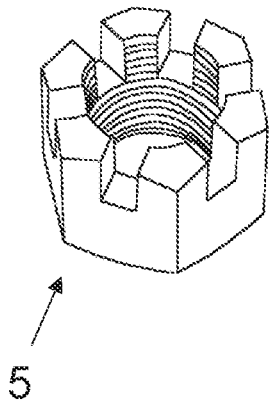
FIG. 3 illustrates a schematically simplified perspective illustration of a propeller nut.
Figure 4:
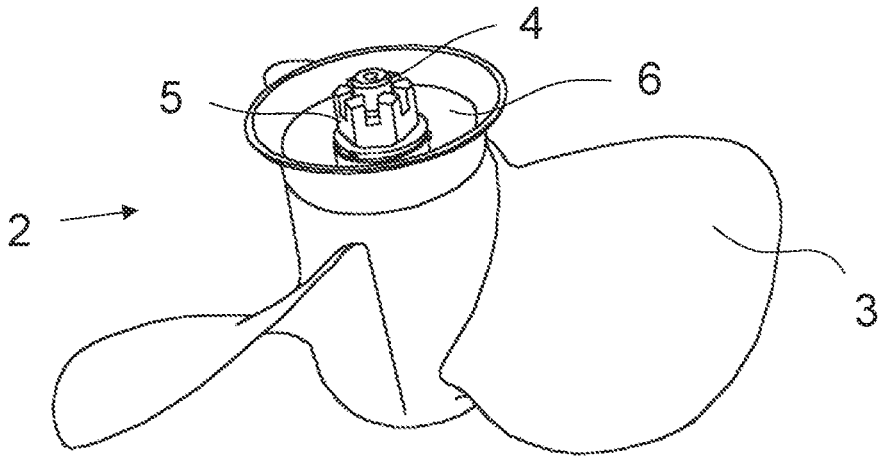
FIG. 4 illustrates a schematically simplified perspective illustration of a propeller system with a propeller nut screwed onto the propeller shaft.

FIGS. 2, 3 and 4 show an assembly of the propeller system 2 in a schematically simplified manner As shown in FIG. 2, a propeller nut 5 is provided for fixing the propeller 3, which is fixed on propeller shaft not shown in FIG. 2 by a cotter pin 7, in order to fasten the propeller 3 on the propeller shaft. FIG. 3 shows an enlarged view of this propeller nut 5, where it is visible that the propeller nut 5 has a hexagonal cross-section and includes recesses at its top between the edges, respectively. In FIG. 4, the propeller system 2 is illustrated in a mounted state, where the propeller 3 is fixed on the propeller shaft 4 by the propeller nut 5. The propeller shaft 4 and the propeller nut 5 are thus centrally located at an exit of the exhaust gas duct 6 of the propeller 3.

Figure 5:
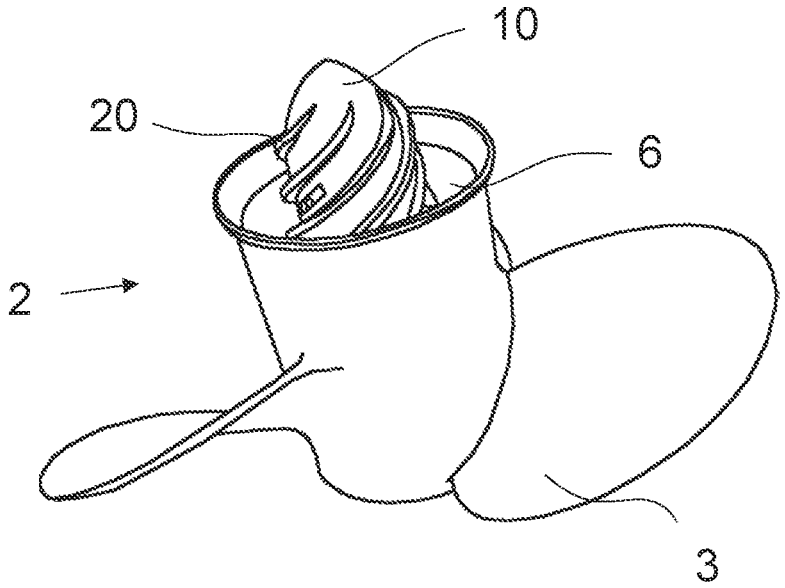
FIG. 5 illustrates a schematically simplified illustration of a propeller system with an end cap attached onto the propeller nut.
Figure 6:
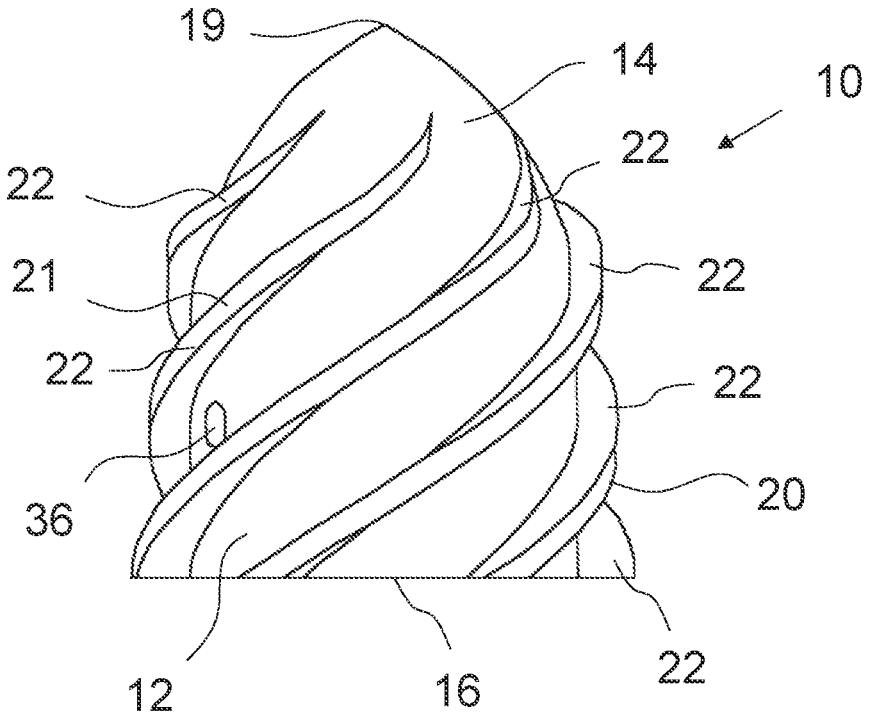
FIG. 6 illustrates a schematically simplified side view of an end cap in a first embodiment.

The exhaust gas flow exiting from the exhaust gas duct 6 can stall during travel, inter alia, due to the nature of the propeller nut 5 and turbulences occur, which negatively affect the flow efficiency in the water. In order to solve this problem, the end cap 10 is provided, which is attached onto the propeller nut 5, as illustrated in a schematically simplified manner in FIG. 5. For fixing the end cap 10, for example, the cotter pin 7 is used, which is not shown in FIG. 4 and FIG. 5 for reasons of clarity. In the embodiment illustrated in FIG. 5, the end cap 10 comprises an exhaust gas guiding structure 20 with multiple exhaust gas guiding elements formed as projections or helixes, with which a suction in the exhaust gas flow is generated additionally, which exerts a positive influence on the exhaust gas counter pressure of the boat engine 1. Thereby, the heterogeneous turbulences are converted into a directed vortex with a suction effect, whereby the efficiency of the boat engine 1 is improved, so that the speed of the boat can be increased and/or the fuel consumption of the boat engine 1 can be reduced.

FIGS. 6 to 9 show a first embodiment of the end cap 10 in different views. In the schematically simplified side view shown in FIG. 6, the end cap 10 includes a base body 12 having a bottom surface 16 and a lateral surface 14 extending from the bottom surface 16 up to a tip 19. Six exhaust gas-guiding elements 21 configured as projections or helixes 22 wind spirally around the lateral surface 14 from the bottom surface 16 in the direction of the tip 19. For reasons of clarity, in FIG. 6 and the following figures, however, only one of the helixes 22 is indicated as an exhaust gas-guiding element 21, although all helixes 22 are also exhaust gas guiding elements 21. The height of the helixes 22, thus their radial extension away from the lateral surface 14, decreases in the direction of the tip 19. All of the exhaust gas guiding elements 21 of the exhaust gas guiding structure 20 end below the tip 19. A bore 36 is provided on the propeller nut 5 for fastening the end cap 10.

Figure 7:
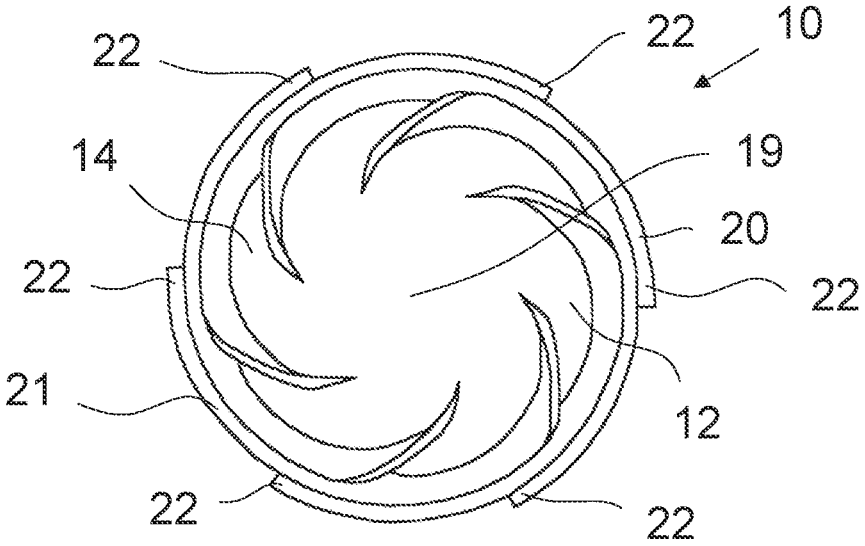
FIG. 7 illustrates a schematically simplified plan view of an end cap according to the first embodiment.

In the plan view of FIG. 7, it is illustrated in a schematically simplified manner that the exhaust gas guiding elements 21 configured as helixes 22 are configured symmetrically offset to each other on the lateral surface 14.

Figure 8:
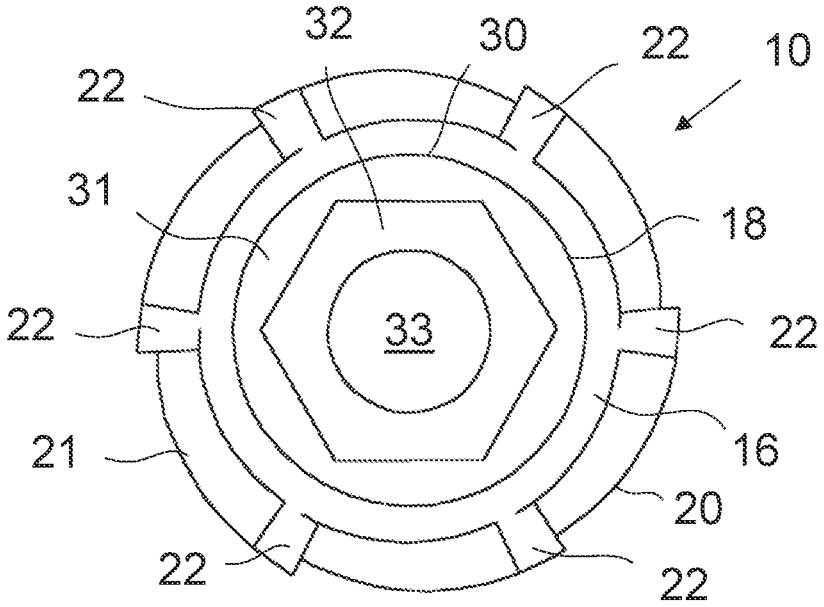
FIG. 8 illustrates a schematically simplified view from below of an end cap according to the first embodiment.

FIG. 8 shows the end cap 10 viewed in a schematically simplified manner from below. In this view, it is visible that the bottom surface 16 is designed annularly and comprises a recess 18 in its center. The recess 18 is configured as a stepped blind hole 30, which comprises an exterior first receiving section 31, a central second receiving section 32 and an inner third receiving section 33. The internal third receiving section 33 is the deepest section and has a circular outer circumference, so that it can receive the protruding part of the propeller shaft 4, as illustrated in FIG. 4. The central second receiving section 32 is shallower than the third receiving section 33 but deeper than the first receiving section 31. The second receiving section 32 is configured for receiving the propeller nut 5 and for this reason has a hexagonal outer circumference. The exterior first receiving section 31 is the shallowest receiving section and is configured and intended to receive the section of the propeller shaft 4, which is disposed below the propeller nut 5, as illustrated in FIG. 4. The number and exact configuration of the different receiving sections 31, 32, 33 is in FIG. 8 purely exemplary and may be adapted to different propeller systems 2 of boat engines 1 in order to securely fasten the end cap 10 on propeller shafts 4 respectively propeller nuts 5 of different engine types.

Figure 9:
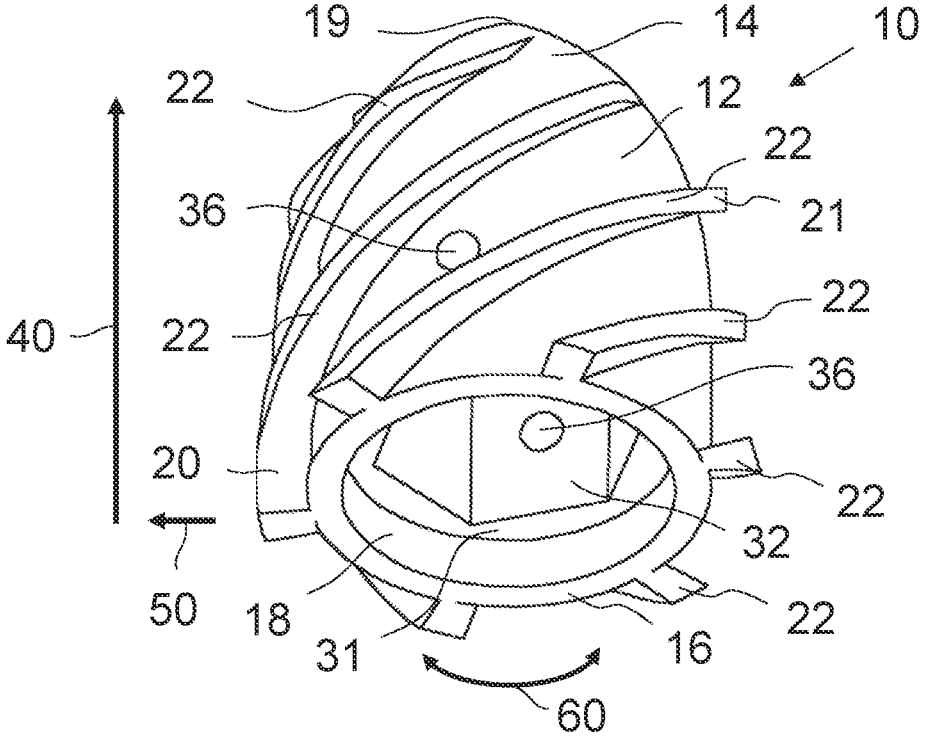
FIG. 9 illustrates a schematically simplified perspective illustration of an end cap in a first embodiment.

FIG. 9 shows the first embodiment of the end cap 10 in a schematically simplified perspective illustration. In this illustration, the different directions of the end cap 10 are indicated in the form of the longitudinal direction 40, the radial direction 50 and the circumferential direction 60. In addition, bore 36 can be seen clearly. Bore 36 extends through the entire width of the base body 12 and thereby passes through the second receiving section 32. By the bore 36, the end cap 10 gets simply and securely fastened on the propeller nut 5 by using the cotter pin 7, which is already provided for fixing the propeller nut 5, and now also used for fixing the end cap 10.

Figure 10:
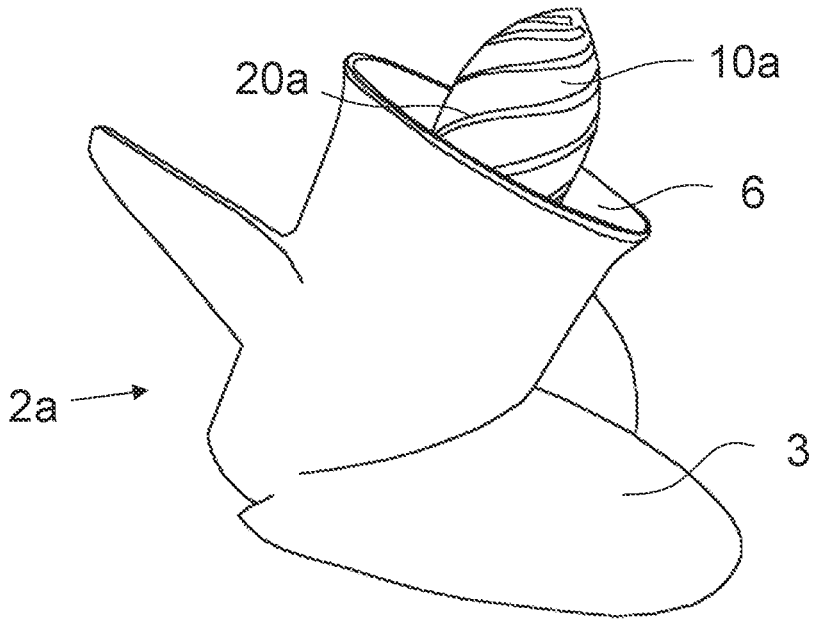
FIG. 10 illustrates a schematically simplified perspective illustration of a propeller system with an end cap according to a second embodiment.
Figure 11:
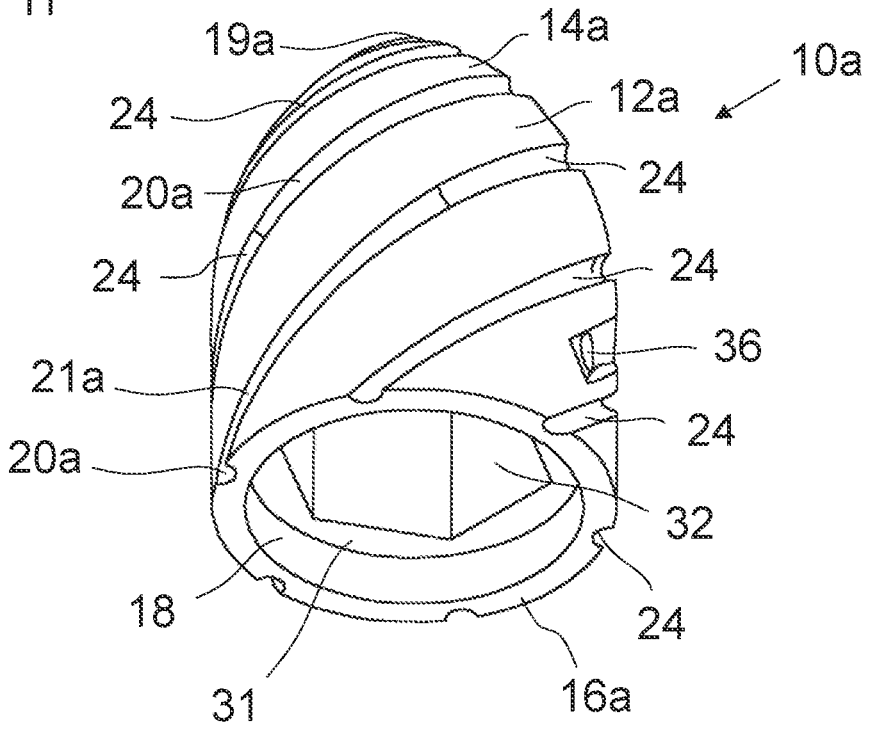
FIG. 11 illustrates a schematically simplified perspective illustration of an end cap according to the second embodiment.

FIG. 10 shows in a schematically simplified manner a propeller system 2*a* with an end cap 10*a* according to a second embodiment. In this embodiment, the exhaust gas guiding structure 20*a* having gas guiding elements 21*a* are not configured as helixes 22, but as grooves 24, as illustrated in the schematically simplified perspective illustration of the end cap 10*a* in FIG. 11. Just like the helixes 22 of the first embodiment, the grooves 24 of the second embodiment wind helically around the lateral surface 14*a* of the base body 12*a* from the bottom surface 16*a* towards the tip 19*a*. Also as in the first embodiment, the exhaust duct structure 20*a* in the second embodiment includes a total of six exhaust gas-guiding elements 21.

Figure 12:
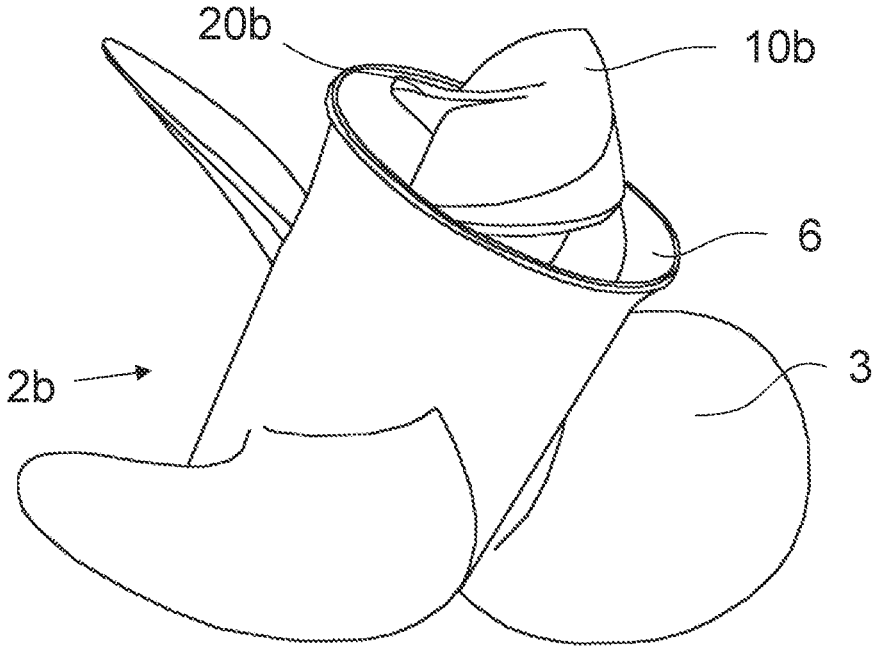
FIG. 12 illustrates a schematically simplified perspective illustration of a propeller system with an end cap according to a third embodiment.
Figure 13:
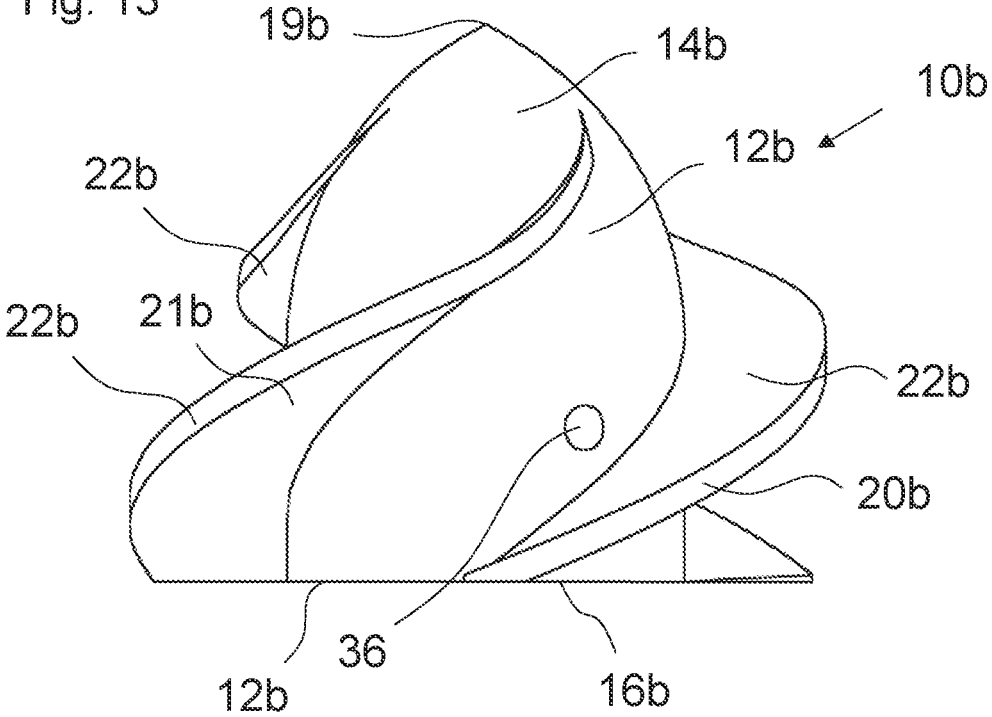
FIG. 13 illustrates a schematically simplified side view of the end cap according to the third embodiment.
Figure 14:
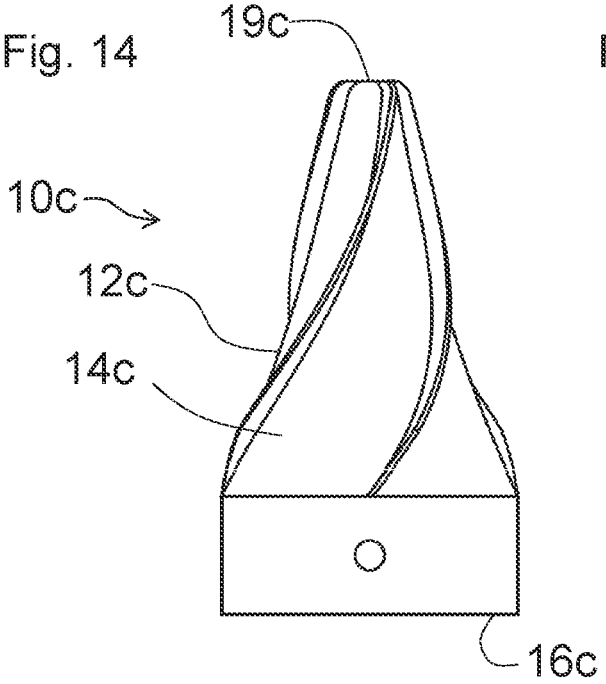
FIG. 14 illustrates a schematically simplified side view of an end cap in a fourth embodiment.
Figure 16:
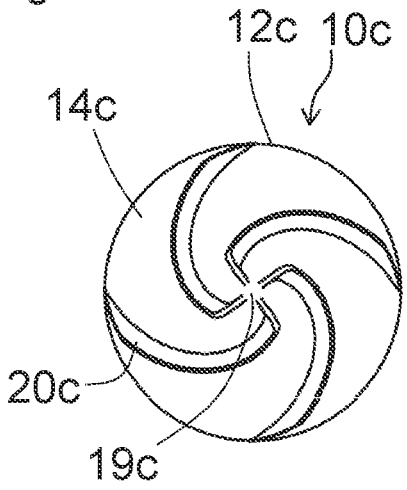
FIG. 16 illustrates a schematically simplified plan view of the tip of the fourth embodiment.
Figure 15:
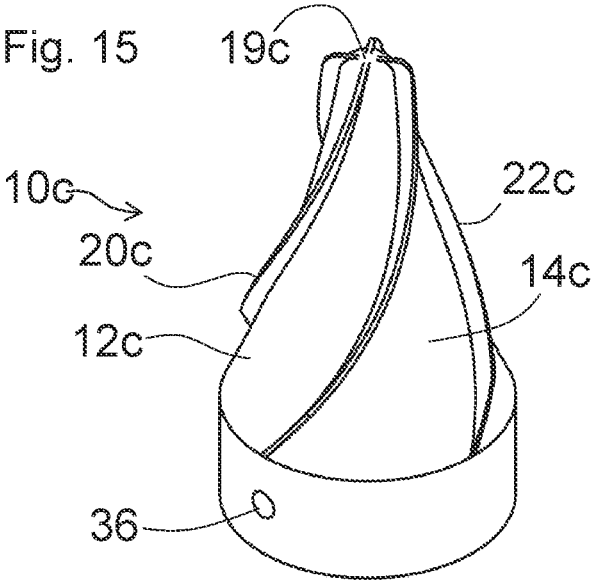
FIG. 15 illustrates a schematically simplified perspective view of the fourth embodiment.
Figure 17:
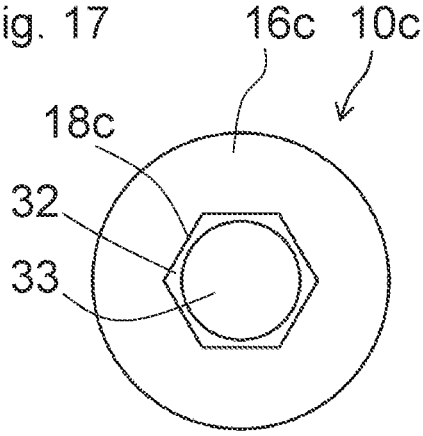
FIG. 17 illustrates a schematically simplified plan view of the bottom side of the fourth embodiment.

A third embodiment of the end cap 10*b* is illustrated in the FIGS. 12 and 13. As in the schematically simplified perspective illustration of the propeller system 2*b* in FIG. 12 visible, the exhaust gas guiding structure 20*b* according to the third embodiment, in turn, includes exhaust gas guiding elements 21*b* configured as projections or helixes 22*b* radially extending from the lateral surface 14*b* of base body 12*b* from the bottom surface 16*b* towards the tip 19*b*. As shown in the schematically simplified side view in FIG. 13, however, the helixes 22*b* are significantly larger than according to the first embodiment. In other words, the height of the helixes 22*b*, thus the extension in the radial direction 50, is significantly more pronounced than in the first embodiment. However, in the third embodiment, only three instead of six exhaust gas-guiding elements 21*b* are provided.

Which type of end cap is used for a given boat engine 1 depends, inter alia, on the propeller size of the propeller 3, the speed and the type of the boat engine 1. In any case, by using the end cap, the occurrence of turbulences in the exhaust gas flow is reduced or avoided and the efficiency of the boat engine 1 is improved.

FIGS. 14 to 17 show different views of a fourth embodiment of an end cap 10*c*. This one differs from the preceding embodiments basically in the concave configuration of the lateral surface 14*c* of the base body 12*c*, which ends in a flattened tip 19*c*. In this case, the helix 22*c* of the exhaust gas guiding elements 21*c* of the gas guiding structure 20*c* runs up to the tip 19*c* of the base body 12*c*. The concave structure is modelled on the characteristic of an exhaust gas vortex behind the propeller. The end cap 10*c* having a bottom surface 16*c* with a bottom shown in FIG. 17, which is configured similarly to that in FIG. 8, 9 or 11.

While there has been shown and described what is considered to be embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

LIST OF REFERENCE SIGNS

1 Boat engine
2, 2*a*, 2*b* Propeller system
3 Propeller
4 Propeller shaft
5 Propeller nut
6 Exhaust gas duct

7 Cotter pin
10, 10*a*, 10*b*, 10*c* End cap
12, 12*a*, 12*b*, 12*c* Base body
14, 14*a*, 14*b*, 14*c* Lateral surface
16, 16*a*, 16*b*, 16*c* Bottom surface
18 Recess
19, 19*a*, 19*b*, 19*c* Tip
20, 20*a*, 20*b*, 20*c* Exhaust gas-guiding structure
21, 21*a*, 21*b*, 21*c* Exhaust gas-guiding element
22, 22*b*, 22*c* Helix
24 Groove
30 Blind hole
31 First receiving section
32 Second receiving section
33 Third receiving section
36 Bore
40 Longitudinal direction
50 Radial direction
60 Circumferential direction

What is claimed is:

1. An end cap for guiding an exhaust gas flow of a boat engine, wherein the end cap is configured to be attached onto a propeller nut of the boat engine, the end cap comprising:

a base body having a bottom surface, a lateral surface and a tip, the tip and the bottom surface being spaced apart from each other in a longitudinal direction of the base body;

wherein the lateral surface extends from the bottom surface and converges in the tip;

the bottom surface having a recess for receiving the propeller nut;

at least one exhaust gas-guiding structure extends helically along the lateral surface; and the recess is configured as a blind hole having an outer first receiving section and an inner second receiving section, the second receiving section is configured deeper than the first receiving section and has a hexagonal outer circumference.

2. The end cap according to claim 1, wherein an amount that the gas-guiding structure extends radially from the bottom surface decreases toward the tip of the base body along a longitudinal direction of the base body from the bottom surface toward the tip of the base body.

3. The end cap according to claim 2, wherein the gas-guiding structure has one of a convex, conical or concave form.

4. The end cap according to claim 1, wherein the exhaust gas-guiding structure ends at the tip or before reaching the tip.

5. The end cap according to claim 1, wherein the exhaust gas-guiding structure includes one of:

at least two exhaust gas guiding elements symmetrically offset to each other and helically running around the lateral surface; or at least six exhaust gas guiding elements.

6. The end cap according to claim 1, wherein the exhaust gas-guiding structure includes at least one projection protruding from the lateral surface in a radial direction.

7. The end cap according to claim 6, wherein a height of the at least one projection in the radial direction at a position nearest the tip is one of 10% to 20%, 20% to 70%, or 40% to 50%, of a diameter of the bottom surface.

8. The end cap according to claim 1, wherein the exhaust gas-guiding structure includes at least one groove introduced into the lateral surface in a radial direction.

9. The end cap according to claim 1, wherein the base body is cylindrical starting at the bottom surface and decreases in width towards the tip.

10. The end cap according to claim 1, wherein a width of the base body decreases in the longitudinal direction from the bottom surface toward the tip.

11. The end cap according to claim 10, wherein a curvature of the lateral surface increases in the longitudinal direction from the bottom surface toward the tip.

12. The end cap according to claim 1, wherein one or more of the tip or the lateral surface are completely closed in the area of the tip.

13. The end cap according to claim 1, wherein the lateral surface having at least one bore for receiving a cotter pin, the bore extending transversely to the longitudinal direction of the base body.

14. The end cap according to claim 1, wherein the bore extending entirely through a width of the lateral surface.

15. The end cap according to claim 1, wherein the first receiving section has a circular outer circumference.

16. The end cap according to claim 1, wherein the blind hole further comprises a third receiving section disposed centrally in the second receiving section and is deeper from the bottom surface than the second receiving section, the third receiving section having a circular outer circumference.

17. A propeller system for a boat engine, the propeller system comprising:

a propeller;

a propeller shaft;

a propeller nut, wherein the propeller is fixed on the propeller shaft by the propeller nut, wherein the propeller has an exhaust gas duct which is disposed concentrically around the propeller shaft; and the end cap according to claim 1, the end cap being attached onto the propeller nut, so that the end cap is one of disposed centrally in the exhaust gas duct or disposed at an end of the exhaust gas duct.

18. A boat engine comprising:

the propeller system according to claim 17.

19. The boat engine according to claim 18, wherein the boat engine is configured as an outboard engine.

* * * * *